US010689868B2

(12) United States Patent
Saadatmanesh et al.

(10) Patent No.: US 10,689,868 B2
(45) Date of Patent: Jun. 23, 2020

(54) REINFORCING METHOD FOR A STRUCTURAL ELEMENT

(71) Applicant: CARBOSHIELD, INC., Tucson, AZ (US)

(72) Inventors: Hamid Saadatmanesh, Tucson, AZ (US); Farokh Mehrshahi, Santa Clara, CA (US); Davoud Zamani, Tucson, AZ (US)

(73) Assignee: CARBOSHIELD, INC., Tucson, AZ (US)

( * ) Notice: Subject to any disclaimer, the term of this patent is extended or adjusted under 35 U.S.C. 154(b) by 0 days.

(21) Appl. No.: 16/321,163

(22) PCT Filed: Jul. 28, 2017

(86) PCT No.: PCT/US2017/044378

§ 371 (c)(1),
(2) Date: Jan. 28, 2019

(87) PCT Pub. No.: WO2018/022997

PCT Pub. Date: Feb. 1, 2018

(65) Prior Publication Data

US 2019/0177992 A1 Jun. 13, 2019

Related U.S. Application Data

(60) Provisional application No. 62/367,762, filed on Jul. 28, 2016.

(51) Int. Cl.
*E04C 3/00* (2006.01)
*E04G 23/02* (2006.01)
(Continued)

(52) U.S. Cl.
CPC ..... *E04G 23/0225* (2013.01); *E04C 3/30* (2013.01); *E04C 3/34* (2013.01); *E04G 2023/0251* (2013.01)

(58) Field of Classification Search
CPC ... E02D 37/00; E04C 3/36; E04C 5/07; E04C 5/085; E04C 5/012; E04C 5/00; E04C 5/073; B29C 70/86; B29C 70/865
(Continued)

(56) References Cited

U.S. PATENT DOCUMENTS 2,897,553 A * 8/1959 Gorrow ..... F16J 15/025 52/835
3,963,546 A * 6/1976 Roberti ..... B27D 1/08 156/69

(Continued)

FOREIGN PATENT DOCUMENTS

| | | | |
|---|---|---|---|
| EP | 0572243 | A1 | 12/1993 |
| WO | 1995023898 | A1 | 9/1995 |
| WO | 2006032033 | A1 | 3/2006 |

OTHER PUBLICATIONS

International Search Report for WO Application No. PCT/US2017/044378 dated Oct. 30, 2017, 4 pages.

(Continued)

*Primary Examiner* — Chi Q Nguyen

(57) ABSTRACT

A method of reinforcing a structural element is disclosed. The method comprises positioning a first rigid fiber-reinforced shell extending between first and second edges partially about an external surface of the structural element to leave an exposed portion of the structural element. The method also comprises positioning a second rigid fiber-reinforced shell extending between first and second edges about the exposed portion of the structural element such the first edge of the second rigid fiber-reinforced shell adjacent the first edge of the first rigid fiber-reinforced shell to give a first seam and the second edge of the second rigid fiber-reinforced shell is adjacent the second edge of the first rigid fiber-reinforced shell to give a second seam. Finally, the method includes adhering the first and second rigid (Continued)

fiber-reinforced shells to the structural element. A reinforced structural element produced by the method is also disclosed.

14 Claims, 4 Drawing Sheets

(51) Int. Cl.
*E04C 3/34* (2006.01)
*E04C 3/30* (2006.01)

(58) Field of Classification Search
USPC ..... 52/835, 834, 741.3, 741.1, 746.1; 156/94; 405/237, 257
See application file for complete search history.

(56) References Cited

U.S. PATENT DOCUMENTS 4,439,071 A * 3/1984 Roper, Jr. ..... E02D 5/60 249/48
5,505,030 A * 4/1996 Michalcewiz ..... E02D 27/34 156/94
5,513,477 A * 5/1996 Farber ..... E04H 12/02 52/834
5,753,340 A 5/1998 Welch et al.
5,996,521 A * 12/1999 Kitano ..... B32B 1/08 114/90
8,341,860 B2 * 1/2013 Boyce ..... E01F 9/623 40/607.01
8,650,831 B2 2/2014 Ehsani
10,119,238 B2 * 11/2018 Doudican ..... E02D 5/64
2004/0048022 A1 * 3/2004 Pratt ..... A63B 60/00 428/36.91
2004/0074199 A1 * 4/2004 Gordin ..... E04H 12/2292 52/848
2008/0017263 A1 1/2008 Robinson et al.
2009/0165404 A1 * 7/2009 Choi ..... E04C 3/34 52/167.1
2015/0159387 A1 6/2015 Chou et al.
2015/0190972 A1 * 7/2015 Ehsani ..... E04G 23/0218 156/71
2016/0060892 A1 * 3/2016 Odegard ..... E04H 12/2292 52/835
2016/0076249 A1 * 3/2016 Gibson ..... B29C 70/521 52/834
2016/0145882 A1 * 5/2016 Ehsani ..... E04G 23/0218 52/741.3

OTHER PUBLICATIONS

Hoff, G. W."Strong medicine. Fiber-reinforced polymer materials can help cure many ills that beset concrete." Concrete Construction (2000): 40-47.

* cited by examiner

REINFORCING METHOD FOR A STRUCTURAL ELEMENT

CROSS-REFERENCE TO RELATED APPLICATIONS

This application is the National Stage of International Patent Application No. PCT/US2017/04437, filed on 28 Jul. 2017, which claims priority to and all of advantages of U.S. Prov. Appl. No. 62/367,762, filed on 28 Jul. 2016, the content of which are herein incorporated by reference.

FIELD OF THE INVENTION

The present invention generally relates to a method of reinforcing a structural element and, more specifically, to a method of reinforcing a structural element with rigid fiber-reinforced shells and to a reinforced structural element formed in accordance with the method.

DESCRIPTION OF THE RELATED ART

Fiber-reinforced polymers have become frequently used in structural engineering applications due to their inherent cost-effectiveness in a number of field applications, including those involving structural materials including concrete, masonry, steel, cast iron, and wood. Fiber-reinforced polymers can be used in industry for retrofitting to strengthen an existing structure and/or as an alternative reinforcing (or pre-stressing) material instead of conventional materials from the outset of a project. Recently, retrofitting has become a dominant industrial use of fiber-reinforced polymers, with applications including increasing the load capacity of old structures, such as bridges, which were designed with much lower service load tolerances than are typically required today. Other uses include seismic retrofitting and repairing damaged structures.

Applied to reinforced concrete structures for flexure, fiber-reinforced polymers typically have a large effect on strength, but only provide a moderate increase in stiffness of the reinforced concrete structures. This is thought to be due to the high strength, but low stiffness, of typical fiber-reinforced polymers. Consequently, however, only small cross-sectional areas of the fiber-reinforced polymers are typically used. Likewise, small areas of fiber-reinforced polymer having very high strength but moderate stiffness applied to a section of a reinforced concrete structure will significantly increase the strength, but not the stiffness of the reinforced concrete structure.

SUMMARY OF THE INVENTION

The present invention provides a method of reinforcing a structural element. The structural element extends for a distance along an axis between first and second ends and presents an external surface. The method comprises (i) positioning a first rigid fiber-reinforced shell extending between first and second edges partially about the external surface of the structural element to leave an exposed portion of the structural element. The method further comprises (ii) positioning a second rigid fiber-reinforced shell extending between first and second edges about the exposed portion of the structural element such the first edge of the second rigid fiber-reinforced shell is adjacent the first edge of the first rigid fiber-reinforced shell to give a first seam and the second edge of the second rigid fiber-reinforced shell is adjacent the second edge of the first rigid fiber-reinforced shell to give a second seam, thereby enveloping at least a portion of the structural element. Finally, the method comprises (iii) adhering the first and second rigid fiber-reinforced shells to the structural element.

A reinforced structural element formed in accordance with the method is also provided.

DETAILED DESCRIPTION OF THE INVENTION

Figure 1:
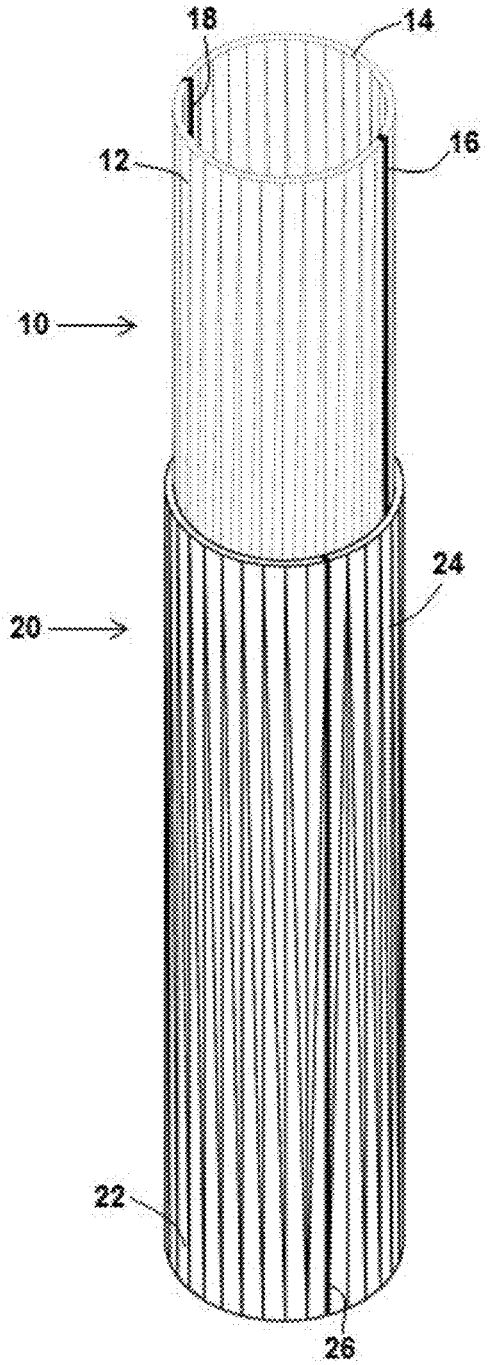
FIG. 1 shows a first pair of rigid fiber-reinforced shells and a second pair of rigid fiber-reinforced shells disposed about the first pair of rigid fiber-reinforced shells.

The present invention provides a method of reinforcing a structural element. The method and elements disclosed herein can be utilized to form new structures, retrofit existing structures, and/or repair or rehabilitate damaged structures (e.g. such as due to corrosion, deterioration, excessive loading, etc.). The structure may be a building, a bridge, a foundation, or the like. The structural element may be any component of the structure. Examples of structural elements include rods, beams, poles, columns, pipes, struts, studs, piles, tubes, bollards, and the like. The structural element may be of any suitable size or proportion, and may have any cross-sectional shape (e.g. circular, elongate, or square cross-section) or configuration (e.g. a flange) and can be designed for any purpose. In addition, the structural element can be constructed of any suitable material, such as concrete, metal, wood, plastic, masonry, stone, and combinations thereof.

The structural element may be present in a variety of locations, such as on, in, or partially in the ground, under or partially under water, and combinations thereof. In certain embodiments, the structural element is at least partially submerged in water (i.e., underwater). In various embodiments, the structural element is at least partially underground. In specific embodiments, the structural element is both at least partially submerged in water and at least partially underground. The term "partially", as used in this context, is used herein to refer to at least a portion of the structural element being underground and/or underwater.

The structural element comprises and extends between at least a first end and a second end, which are separated by a distance along an axis A. The distance between the first and second ends can be any distance, such as a distance of from 0.5 to 100,000 feet (where 1 foot is 0.3048 meters). Typically, the distance between the first and second ends is a distance of from 1 to 200, alternatively from 5 to 150, alternatively from 10 to 100, feet. The structural element may have other portions extending from the axis A. For example, in some embodiments the structural element may be bifurcated.

The structural element also presents an external surface having a perimeter extending for a distance around a plane lying perpendicular to the axis A (i.e., a cross section). The external surface presents a shape of the structural element. The shape of the structural element may be any shape, such as cubic, cylindrical, pyramidal, conical, prismatic, trapezoidal, and the like, and combinations thereof. The external surface may also be of any contour, such as smooth or rough, flat or textured, and the like, or combinations thereof. Moreover, any portion of the external surface may be the same as or different from any other portion of the external surface. In some embodiments, the external surface is substantially flat (or smooth). In certain embodiments, the external surface is textured (or rough). In specific embodiments, the external surface is ribbed and/or includes reinforcing structures. In specific embodiments, the shape of the structural element is a cylinder, such that the perimeter of the external surface of the structural element may be further defined as a circumference.

The structural element further includes an outer radius extending radially from the axis A to the external surface. The outer radius can be any distance, such as a distance of from 1/12 to 100 feet, although distances outside of this range are also contemplated for the outer radius. Typically, the outer radius will be a distance of from 1/6 to 75, alternatively from 1/5 to 50, alternatively from 1/4 to 25, alternatively from 1/3 to 10, feet. In some embodiments, the structural element is a concentric cylinder that includes the outer radius and further includes an inner radius that extents from the axis A for distance less than the outer radius. It is to be appreciated that the structural element may comprise multiple radii, each independently of the same or different distance, depending on the shape of the structural element.

The method can be used to reinforce any portion of the structural element or the entire structural element. In some embodiments, the method is used to reinforce only a portion of the structural element. In certain embodiments, the method is used to reinforce the entire structural element.

The method utilizes rigid fiber-reinforced shells. Typically, the method comprises a number of pairs of rigid fiber-reinforced shells, such as 1, 2, 3, 4, 5, 6, 7, 8, 9, 10, 11, 12, 13, 14, 15, 16, 17, 18, 19, or 20 (or more) pairs of rigid fiber-reinforced shells. Each pair of rigid fiber-reinforced shells comprises two rigid fiber-reinforced shells. For example, the method comprises at least a first pair of rigid fiber-reinforced shells comprising both a first rigid fiber-reinforced shell and a second rigid fiber-reinforced shell. In some embodiments, the method further comprises a second pair of rigid fiber-reinforced shells comprising a third rigid fiber-reinforced shell and a fourth rigid fiber-reinforced shell. In certain embodiments, the method further comprises additional pairs of rigid fiber-reinforced shells.

It is to be appreciated that each rigid fiber-reinforced shell is independently selected and any one of the rigid fiber-reinforced shells may be partially the same, substantially the same, or the same as any other of the rigid fiber-reinforced shells. The term "same" is to be understood to refer to one rigid fiber-reinforced shell having at least one common property, dimension, shape, composition, or the like, to another rigid fiber-reinforced shell. Accordingly, it is also to be understood that, absent description to the contrary, reference to any one or more particular rigid fiber-reinforced shell, in either a singular or a plural form, may be descriptive of one or more of the rigid fiber-reinforced shells generally, within a pair of rigid fiber-reinforced shells, within different pairs of rigid fiber-reinforced shells, and the like. Typically, depending on a configuration and shape of the structural element, both rigid fiber-reinforced shells of a pair of rigid fiber-reinforced shells are complementary in shape and dimension. For example, in some embodiments the first and second rigid fiber-reinforced shells of the first pair of rigid fiber-reinforced shells are substantially the same. Likewise, in some embodiments, the third and fourth rigid fiber-reinforced shells of the second pair of rigid fiber-reinforced shells are substantially the same. However, it is to be appreciated that the method may also utilize at least one pair of rigid fiber-reinforced shells comprising two rigid fiber-reinforced shells that are not complementary to one another. Accordingly, any one of the rigid fiber-reinforced shells need not be substantially the same as any other of the rigid fiber-reinforced shells.

In general, each rigid fiber-reinforced shell comprises a first end and a second end, and a height extending for a distance between the first and second ends. In certain embodiments, the height of the rigid fiber-reinforced shells extends between the first and second ends for a distance along an axis A. However, it is to be appreciated that each rigid fiber-reinforced shell need not be linear. Rather, in some embodiments the rigid fiber-reinforced shells are curved, arcuate, bent, or combinations thereof. The height of each rigid fiber-reinforced shell can be any distance, such as a distance of from 1/12 to 1,000 feet. Typically, the height of each rigid fiber-reinforced shell is a distance of from 1/6 to 900, alternatively from 1/5 to 800, alternatively from 1/4 to 700, alternatively from 1/3 to 600, alternatively from 1/2 to 500, alternatively from 2/3 to 400, alternatively from 3/4 to 300, alternatively from 5/6 to 200, alternatively from 1 to 100, feet. Each rigid fiber-reinforced shell also includes at least a first edge and a second edge, with each of the first and second edges extending for a distance along at least a portion of the height of the rigid fiber-reinforced shell. The portion of the height may be any distance, such as a distance up to and including the entire distance of the height. In certain embodiments, the portion of the height is the entire distance of the height of the rigid fiber-reinforced shell, or a distance greater than the height of the rigid fiber-reinforced shell (i.e., when the first and/or second edge is not parallel to the height of the rigid fiber-reinforced shell). Each rigid fiber-reinforced shell also has a width extending for a distance between the first and second edges. The width of the rigid fiber-reinforced shell is typically perpendicular, or substantially perpendicular, to the height of the rigid fiber-reinforced shell. Likewise, the height of the rigid fiber-reinforced shell is typically parallel, or substantially parallel, to the first and second edges. However, in certain embodiments, the height is not parallel, or substantially parallel, to the first edge and/or second edge. Likewise, in these or other embodiments, the width of the rigid fiber-reinforced shell is not perpendicular, or substantially perpendicular, to the height of the rigid fiber-reinforced shell. The width of each rigid fiber-reinforced shell can be any distance, such as a distance of from 1/12 to 1,000 feet. Typically, the width of each rigid fiber-reinforced shell is a distance of from 1/6 to 900, alternatively from 1/5 to 800, alternatively from 1/4 to 700, alternatively from 1/3 to 600, alternatively from 1/2 to 500, alternatively from 2/3 to 400, alternatively from 3/4 to 300, alternatively from 5/6 to 200, alternatively from 1 to 100, feet.

Each rigid fiber-reinforced shell also presents at least an interior surface and an exterior surface. The interior and exterior surfaces of the rigid fiber-reinforced shell may be, independently, of any shape, texture, and/or contour, such as smooth or rough, flat or textured, and the like, or combinations thereof. Accordingly, it is to be appreciated that the interior and exterior surfaces of any one shell may be the same or different. As such, in some embodiments, the interior and exterior surfaces of any one shell are complementary. Additionally, the interior and/or exterior surface of any one of the rigid fiber-reinforced shells may be the same as or different from the interior and/or exterior surface of any other of the rigid fiber-reinforced shells. In some embodiments, the interior and/or exterior surface of the rigid fiber-reinforced shell is substantially flat. In certain embodiments, the interior and/or exterior surface of the rigid fiber-reinforced shell is textured. In specific embodiments, the interior and/or exterior surface of the rigid fiber-reinforced shell is ribbed and/or includes reinforcing structures.

In some embodiments, and as described in further detail below, the width of each rigid fiber-reinforced shell is independently a distance less than the distance of the perimeter of structural element, such as a distance of from 25 to 75, alternatively from 30 to 70, alternatively from 40 to 60, alternatively from 45 to 65, % of the perimeter of the structural element. In specific embodiments, the width of each of the first and second rigid fiber-reinforced shells is a distance of from 50 to 60% of the distance of the perimeter of the structural element. Additionally, the sum of the widths of the first and second rigid fiber-reinforced shells is a distance greater than the distance of the perimeter of the structural element. Furthermore, in some embodiments, the sum of the widths of the third and fourth rigid fiber-reinforced shells is a distance greater than the sum of the widths of the first and second rigid fiber-reinforced shells.

Each rigid fiber-reinforced shell comprises a resin and fiber. The resin may be any resin known in the art. Typically, thermosetting and/or thermoplastic resins are utilized due to the effectiveness of molding such resins through processes such as press molding and injection molding, and due to the good impact strength of molded products made therefrom. Accordingly, in some embodiments, the resin is a thermosetting and/or a thermoplastic resin. In these or other embodiments, elastomer or rubber can be added to or compounded with the thermosetting and/or thermoplastic resin to improve certain properties such as impact strength.

General examples of suitable thermosetting and/or thermoplastic resins typically include epoxy resins, polyester resins, phenolic resins (e.g. resol type), urea resins (e.g. melamine type), polyimide resins, and the like, as well as copolymers, modifications, and combinations thereof. Some specific examples of suitable thermosetting and/or thermoplastic resins include polyamides; polyesters such as polyethylene terephthalates, polybutylene terephthalates, polytrimethylene terephthalates, polyethylene naphthalates, liquid crystalline polyesters, and the like; polyolefins such as polyethylenes, polypropylenes, polybutylenes, and the like; styrenic resins; polyoxymethylenes; polycarbonates; polymethylenemethacrylates; polyvinyl chlorides; polyphenylene sulfides; polyphenylene ethers; polyimides; polyamideimides; polyetherimides; polysulfones; polyethersulfones; polyketones; polyetherketones; polyetheretherketones; polyetherketoneketones; polyarylates; polyethernitriles; phenolic resins; phenoxy resins; fluorinated resins, such as polytetrafluoroethylenes; thermoplastic elastomers, such as polystyrene types, polyolefin types, polyurethane types, polyester types, polyamide types, polybutadiene types, polyisoprene types, fluoro types, and the like; and copolymers, modifications, and combinations thereof.

In some embodiments the thermosetting and/or thermoplastic resin comprises, alternatively is, an epoxy resin. The term "epoxy" represents a compound comprising a cross-linked reaction product of a typically polymeric compound having one or more epoxide groups (i.e., an epoxide) and a curing agent. Thus, suitable epoxy resins include those formed by reacting an epoxide with a curing agent. The term "epoxy" is conventionally used to refer to an uncured resin that contains epoxide groups. With such usage, once cured, the epoxy resin is no longer an epoxy, or no longer includes epoxide groups, but for any unreacted or residual epoxide groups or reactive sites, which may remain after curing, as understood in the art. However, unless description to the contrary is provided, reference to epoxy herein in the context of an epoxy resin shall be understood to refer to a cured epoxy resin. The term "cured epoxy" shall be understood to mean the reaction product of an epoxide as defined herein and a curing agent as defined herein.

It is to be understood that the terms "curing agent" and "cross-linking agent" can be used interchangeably. Curing agents suitable for use in forming suitable epoxy resins are typically difunctional molecules that are reactive with epoxide groups. The term "cured" refers to a composition that has undergone cross-linking at an amount of from about 50% to about 100% of available cure sites. Additionally, the term "uncured" refers to the composition when it has undergone little or no cross-linking. However, it is to be understood that some of the available cure sites in an uncured composition may be cross-linked. Likewise, some of the available cure sites in a cured composition may remain uncross-linked. Thus, the terms "cured" and "uncured" may be understood to be functional terms. Accordingly, an uncured composition is typically characterized by a solubility in organic solvents and an ability to undergo plastic flow. In contrast, a cured composition suitable for the practice of the present invention is typically characterized by an insolubility in organic solvents and an absence of plastic flow under ambient conditions.

Examples of suitable epoxides include aliphatic, aromatic, cyclic, acyclic, and polycyclic epoxides, and modifications and combinations thereof. The epoxide may be substituted or unsubstituted, and hydrophilic or hydrophobic. Typically, the epoxide has an epoxy value (equiv./kg) of about 2 or greater, such as from 2 to 10, alternatively from 2 to 9, alternatively from 2 to 8, alternatively from 2 to 7, alternatively from 2.5 to 6.5.

Specific examples of suitable epoxides include glycidyl ethers of biphenol A and bisphenol F, epoxy novolacs (such as epoxidized phenol formaldehydes), naphthalene epoxies, trigylcidyl adducts of aminophenols, tetraglycidyl amines of methylenedianilines, triglycidyl isocyanurates, hexahydro-o-phthalic acid-bis-glycidyl esters, hexahydro-m-phthalic acid-bis-glycidyl esters, hexahydro-p-phthalicacid-bis-glycidyl esters, and modifications and/or combinations thereof.

Examples of suitable curing agents include phenols, such as biphenol, bisphenol A, bisphenol F, tetrabromobisphenol A, dihydroxydiphenyl sulfone, phenolic oligomers obtained by the reaction of above mentioned phenols with formaldehyde, and combinations thereof. Additional examples of suitable curing agents include anhydride curing agents such as nadic methyl anhydride, methyl tetrahydrophthalic anhydride, and aromatic anhydrides such pyromellitic dianhydride, biphenyltetracarboxylic acid dianhydride, benzophenonetetracarboxylic acid dianhydride, oxydiphthalic acid dianhydride, 4,4'-(hexafluoroisopropylidene) diphthalic acid dianhydride, naphthalene tetracarboxylic acid dianhydrides, thiophene tetracarboxylic acid dianhydrides, 3,4,9,10-perylenetetracarboxylic acid dianhydrides, pyrazine tetracarboxylic acid dianhydrides, 3,4,7,8-anthraquinone tetracarboxylic acid dianhydrides, oligomers or polymers obtained by the copolymerization of maleic anhydride with ethylene, isobutylene, vinyl methyl ether, and styrene, and combinations thereof. Further examples of suitable curing agents include maleic anhydride-grafted polybutadiene.

In some embodiments the thermosetting and/or thermoplastic resin comprises, alternatively is, a polyamide resin. Examples of suitable polyamides include polycaproamides (e.g. Nylon 6), polyhexamethyleneadipamides (e.g. Nylon 66), polytetramethyleneadipamides (e.g. Nylon 46), polyhexamethylenesebacamides (e.g. Nylon 610), polyhexamethylenedodecamides (e.g. Nylon 612), polyundecaneamides, polydodecaneamides, hexamethyleneadipamide/caproamide copolymers (e.g. Nylon 66/6), caproamide/hexamethyleneterephthalamide copolymers (e.g. Nylon 6/6T), hexamethyleneadipamide/hexamethyleneterephthalamide copolymers (e.g. Nylon 66/6T) hexamethyleneadipamide/hexamethyleneisophthalamide copolymers (e.g. Nylon 66/6I), hexamethyleneadipamide/hexamethyleneisophthalamide/caproamide copolymers (e.g. Nylon 66/6I/6), hexamethyleneadipamide/hexamethyleneterephthalamid/carpoamide copolymers (e.g. Nylon 66/6T/6), hexamethyleneterephthalamide/hexamethyleneisophthalamide copolymers (e.g. Nylon 6T/6I), hexamethyleneterephthalamide/dodecanamide copolymers (e.g. Nylon 6T/12), hexamethyleneadipamide/hexamethyleneterephthalamide/hexamethyleneisophthalamide copolymers (e.g. Nylon 66/6T/6I), polyxylyleneadipamides, hexamethyleneterephthalamide/2-methylpentamethyleneterephthalamide copolymers, polymetaxylylenediamineadipamides (e.g. Nylon MXD6), polynonamethyleneterephthalamides (e.g. Nylon 9T), and combinations thereof.

In some embodiments the thermosetting and/or thermoplastic resin comprises, alternatively is, a phenol resin. Examples of suitable phenol resins include resins prepared by homopolymerzing or copolymerizing components containing at least a phenolic hydroxyl group. Specific examples of suitable phenol resins include phenolic resins such as phenolnovolaks, cresolnovolaks, octylphenols, phenylphenols, naphtholnovolaks, phenolaralkyls, naphtholaralkyls, phenolresols, and the like, as well as modified phenolic resins such as alkylbenzene modified (especially, xylene modified) phenolic resins, cashew modified phenolic resins, terpene modified phenolic resins, and the like. Further examples of suitable phenol resins include 2,2-bis(4-hydroxyphenyl)propane (generally referred to as bisphenol A), 2,2-bis(4-hydroxyphenyl)methane, 1,1-bis(4-hydroxyphenyl)ethane, 1,1-bis(4-hydroxyphenyl)cyclohexane, 2,2-bis(4-hydroxy-3,5-dimethylphenyl)propane, 2,2-bis(4-hydroxy-3,5-dibromophenyl)propane, 2,2-bis(hydroxy-3-methylphenyl)propane, bis(4-hydroxyphenyl)sulfide, bis(4-hydroxy-phenyl)sulfone, hydroquinone, resorcinol, 4,6-dimethyl-2,4,6-tri(4-hydroxyphenyl)heptene, 2,4,6-dimethyl-2,4,6-tri(4-hydroxyphenyl)heptane, 2,6-dimethyl-2,4,6-tri(4-hydroxyphenyl)heptene, 1,3,5-tri(4-hydroxyphneyl)benzene, 1,1,1-tri(4-hydroxyphenyl) ethane, 3,3-bis(4-hydroxyaryl)oxyindole, 5-chloro-3,3-bis(4-hydroxyaryl)oxyindole, 5,7-dichloro-3,3-bis(4-hydroxyaryl) oxyindole, 5-brome-3,3-bis(4-hydroxyaryl) oxyindole, and combinations thereof.

In some embodiments the thermosetting and/or thermoplastic resin comprises, alternatively is, a polyester resin. Examples of suitable polyester resins include polycondensation products of a dicarboxylic acid and a glycol, ring-opened polymers of a cyclic lactone, polycondensation products of a hydroxycarboxylic acid, and polycondensation products of a dibasic acid and a glycol. Specific examples of suitable polyester resins include polyethylene terephthalate resins, polypropylene terephthalate resins, polytrimethylene terephthalate resins, polybutylene terephthalate resins, polyethylene naphthalate resins, polybutylene naphthalate resins, polycyclohexanedimethylene terephthalate resins, polyethylene-1,2-bis(phenoxy) ethane-4,4'-dicarboxylate resins, polyethylene-1,2-bis(phenoxy)ethane-4,4'-dicarboxylate resins, as well as copolymer polyesters such as polyethylene isophthalate/terephthalate resins, polybutylene terephthalate/isophthalate resins, polybutylene terephthalate/decanedicarboxyate resins, and polycyclohexanedimethylene terephthalate/isophthalate resins, and combinations thereof.

The fiber comprises any fibrous material, such as carbon fiber, fiberglass, basalt fiber, natural fiber, metal fiber, polymer-based fibers such as aramid (e.g. Kevlar, Nomex, Technora), and combinations thereof. It is to be appreciated that the term "fiber" can denote a single fiber and/or a plurality of fibers. Herein, use of the term "fiber" denotes one or more individual fibers, which can be independently selected based on composition, size, length, and the like, or combinations thereof. For clarity and consistency, reference to "the fiber" is made herein, which is not intended to refer to just one fiber, but to any one fiber, which may be independently selected. The description below may relate to a single fiber, or all of the fibers, utilized.

In some embodiments, the fiber comprises more than one type of fibrous material. The fiber may be present in the rigid fiber-reinforced shells in the form of strings, wires, fabrics, tubes, particles, cables, strands, monofilaments, and combinations thereof. Additionally, the fiber may be woven or nonwoven. In some embodiments, the fiber is present in the rigid fiber-reinforced shells in the form of a filament product. Filament products include spun yarns (e.g. woven fabrics, knits, braids, etc.) webs (e.g. papers, mats, etc.), and chopped and milled fibers. In certain embodiments, the fiber is a staple product. Staple products include spun staple yarns, fabrics, knits, and braids of staple yarn, webs of staple including felts, mats, and papers, and chopped or milled staple fibers.

The fiber within each rigid fiber-reinforced shell may be randomly oriented or selectively oriented, such as aligned in one direction, oriented in cross directions, oriented in curved sections, and combinations thereof. The orientation of the fiber may be selected to provide various mechanical properties to the rigid fiber-reinforced shell such as tearing tendency, differential tensile strength along different directions, and the like.

In some embodiments, the fiber is arranged in the rigid fiber-reinforced shell in a direction running substantially parallel or parallel to the axis A, and the length of the fiber is substantially equal to the height of the rigid fiber-reinforced shell. When the fiber is curved, bent or twisted, the length of the fiber can be slightly longer than the height of the rigid fiber-reinforced shell. The phrase "substantially equal to" includes these cases. If almost equal shape of cross-section of the rigid fiber-reinforced shell is maintained in the axial direction, the length of the fiber may be generally regarded as substantially equal to the height of rigid fiber-reinforced shell. In certain embodiments, the fiber is arranged in the rigid fiber-reinforced shell in a direction running substantially perpendicular or perpendicular to the axis A and the length of the fiber is substantially equal to the width of the rigid fiber-reinforced shell.

In some embodiments, the fiber is a carbon fiber. The carbon fiber may be or include graphene fibers, graphite fibers, and combinations thereof. The carbon fiber may be or include polyacrylonitrile (PAN)-type carbon fiber, pitch type carbon fiber, or combinations thereof. The carbon fiber may be in any form, such as single layer fibers, multilayer fibers, nanotubes, linked-particles, and combinations thereof. In these or other embodiments, the fiber further comprises an additional fibrous material, such as glass fiber, basalt fiber, natural fiber, metal fiber, polymer-based fiber such as aramid (e.g. Kevlar, Nomex, Technora), and the like, or combinations thereof.

In some embodiments, one or more of the rigid fiber-reinforced shells may further comprise additional components. Examples of additional components include: fillers, such as mica, talc, kaoline, sericite, bentonite, xonotlite, sepiolite, smectite, montmorillonite, wollastonite, silica, calcium carbonate, glass bead, glass flake, glass micro balloon, clay, molybdenum disulphide, titanium oxide, zinc oxide, antimony oxide, calcium polyphosphate, graphite, barium sulfate, magnesium sulfate, zinc borate, calcium borate, aluminum borate whisker, potassium titanate whisker, polymer, and the like; flame retardants and flame retardant aids; pigments; dyes; lubricants; releasing agents; compatibilizers; dispersants; crystallizing agents, such as mica, talc, kaoline, and the like; plasticizers, such as phosphate esters and the like; thermal stabilizers; antioxidants; anticoloring agents; UV absorbers; flowability modifiers; foaming agents; antimicrobial and/or antifouling agents; dust controlling agents; deodorants; sliding modifiers; antistatic agents, such as polyetheresteramide and the like; and combinations thereof. In certain embodiments, the rigid fiber-reinforced shells further comprise two or more additional components.

In some embodiments, the method further comprises forming the rigid fiber-reinforced shells. The rigid fiber-reinforced shells are typically formed by a molding process. Each rigid fiber-reinforced shell may be formed via independently selected techniques and/or methods. Accordingly, any one of the rigid fiber-reinforced shells may be formed by the same or different techniques and/or methods as any other of the rigid fiber-reinforced shells. Examples of suitable molding processes include: injection molding, such as injection compression molding, gas assisted injection molding, insert molding, and the like; blow molding; rotary molding; extrusion molding; press molding; transfer molding, such as resin transfer molding, resin injection molding, Seemann Composites Resin Infusion Molding Process, and the like; filament winding molding; autoclave molding; hand lay-up molding; and the like, and combinations thereof. In some embodiments, at least one of the rigid fiber-reinforced shells is formed via a single molding process, such as injection molding. In certain embodiments, at least one of the rigid fiber-reinforced shells is forming via more than one molding process, such as via a combination of extrusion and injection molding. In such certain embodiments, forming the rigid fiber-reinforced shells may be performed in a single mold or multiple molds. In various embodiments, forming the first and second rigid fiber-reinforced shells comprises extruding the first and second rigid fiber-reinforced shells.

It is to be appreciated that the techniques and methods described above may be used to form the rigid fiber-reinforced shells as a single layer or a composite comprising multiple layers. In some embodiments, at least one of the rigid fiber-reinforced shells is formed from a single shot/pour to give a single layer. In certain embodiments, at least one of the rigid fiber-reinforced shells is formed from multiple shots/pours to give multiple layers, e.g. a composite. In these or other embodiments, one or more of the multiple layers is a reinforcing layer comprising steel, plastic, wood, resin, plastic, and the like, or combinations thereof.

In specific embodiments, the rigid fiber-reinforced shells comprise carbon fiber-reinforced epoxy and are formed by extrusion molding.

As introduced above, the method includes (i) positioning the first rigid fiber-reinforced shell partially about a portion of the external surface presented by the structural element to leave an exposed portion of the structural element.

Positioning the first rigid fiber-reinforced shell partially about the portion of the external surface presented by the structural element comprises disposing at least a portion of the interior surface of the first rigid fiber-reinforced shell into close proximity with the portion of the external surface presented by the structural element. The term "close proximity" as used herein is to be understood to refer to a close distance, and to encompass situations including abutting, adjoining, touching, being spaced apart, being contiguous, being adjacent, and the like, and combinations thereof. The close distance may be any distance suitable for reinforcing the structural element with the method described herein, and may be selected on a basis of: the shape, size, location, and/or type of the structural element; the shape and/or size of one or more of the fiber-reinforced shells; adhering one of the rigid fiber-reinforced shells to another of the rigid fiber-reinforced shells and/or the structural element, as described in further detail below; or combinations thereof. In some embodiments, at least a portion of the interior surface of the first rigid fiber-reinforced shell is disposed about and contiguous to the external surface of the structural element. In certain embodiments, at least a portion of the interior surface of the first rigid fiber-reinforced shell is disposed about and spaced apart from the external surface of the structural element, e.g. to define a gap therebetween. In both such instances, the first rigid fiber-reinforced shell may be considered adjacent the structural element.

In some embodiments, the interior surface of the first rigid fiber-reinforced shell is shaped complementarily to at least a portion of the external surface presented by the structural element. By complementary shape, it is meant that the interior surface of the first rigid fiber-reinforced shell and the external surface of the structural element are similar in shape and dimension. In such some embodiments, positioning the first rigid fiber-reinforced shell partially about the portion of the external surface presented by the structural element typically comprises disposing the interior surface of the first rigid fiber-reinforced shell into close proximity with (i.e., adjacent to) the portion of external surface presented by the structural element that is complimentary to the interior surface of the first rigid fiber-reinforced shell.

The method also includes (ii) positioning the second rigid fiber-reinforced shell about the exposed portion of the structural element.

Positioning the second rigid fiber-reinforced shell about the exposed portion of the structural element comprises disposing at least a portion of the interior surface of the second rigid fiber-reinforced shell into close proximity with (i.e., adjacent to) the exposed portion of the external surface of the structural element. In some embodiments, the interior surface of the second rigid fiber-reinforced shell is shaped complementarily to at least a portion of the exposed portion of the external surface of the structural element. In such some embodiments, positioning the second rigid fiber-reinforced shell about the exposed portion of the structural element typically comprises disposing the interior surface of the second rigid fiber-reinforced shell into close proximity with the portion of the shape presented by the exposed portion of the external surface of the structural element that is complimentary to the interior surface of the first rigid fiber-reinforced shell. In some embodiments, at least a portion of the interior surface of the second rigid fiber-reinforced shell is disposed about and contiguous to the external surface of the structural element. In certain embodiments, at least a portion of the interior surface of the second rigid fiber-reinforced shell is disposed about and spaced from the external surface of the structural element, e.g. to define a gap therebetween.

Positioning the second rigid fiber-reinforced shell about the exposed portion of the structural element also comprises disposing the first edge of the second rigid fiber-reinforced shell adjacent to the first edge of the first rigid fiber-reinforced shell to give a first seam and disposing the second edge of the second rigid fiber-reinforced shell adjacent to the second edge of the first rigid fiber-reinforced shell to give a second seam, thereby enveloping at least a portion of the structural element. The first and/or second edges of the first and second rigid fiber-reinforced shells may be disposed contiguous to, overlapping with, or spaced apart from one another, or combinations thereof. In some embodiments, the first and/or second edges of the first and second rigid fiber-reinforced shells are disposed contiguous to one another. In certain embodiments, the first and/or second edges of the first and second rigid fiber-reinforced shells are disposed adjacent to, but not touching, one another. In specific embodiments, the first and/or second and/or second edges of the first and second rigid fiber-reinforced shells are disposed overlapping one another.

It is to be appreciated that the widths of the first and second rigid fiber-reinforced shells determine the orientation of the first and second seams, with respect to one another, about the axis A. For example, where the widths of the first and second rigid fiber-reinforced shells are substantially equal, the first and second seams are substantially opposite one another about the axis A. Typically, the first and second seams are arranged about the axis A in an orientation of from 170 to 190, alternatively from 175 to 185, alternatively of 180, degrees with respect to one another.

The method further includes (iii) adhering the first and second rigid fiber-reinforced shells to the structural element.

Adhering the first and second rigid fiber-reinforced shells to the structural element typically comprises applying a first adhesive between the interior surfaces of the first and second rigid fiber-reinforced shells and the external surface presented by the structural element. The first adhesive can be applied by any means, such as via brushing, rolling, spraying, pumping, and the like. The first adhesive can be applied manually or by an automated process. In certain embodiments, the first adhesive is applied between the interior surfaces of the first and second rigid fiber-reinforced shells and the external surface presented by the structural element by pumping or spraying, such as via an applicator or spray gun. If the first and second rigid fiber-reinforced shells are positioned such that there is a gap between the first and second rigid fiber-reinforced shells and the exterior structural element, the first adhesive can be disposed in the gap by any such techniques. It is also to be appreciated that the first adhesive may be applied to the interior surfaces of the first and second rigid fiber-reinforced shells and the external surface of the structural element at any time, and in any order. For example, in some embodiments, the first adhesive may be applied to the interior surfaces of the first and second rigid fiber-reinforced shells prior to such shells being positioned about the structural element. In these or other embodiments, the first adhesive may be applied to the interior surfaces of the first and second rigid fiber-reinforced shells subsequent to such shells being positioned about the structural element. In some embodiments, the first adhesive may be applied to the external surface of the structural element prior to the first and second rigid fiber-reinforced shells such shells being positioned about the structural element.

The first adhesive can be any adhesive suitable for bonding the first and second rigid fiber-reinforced shells to the structural element, such as a cement, glue, resin, and the like. Further, the first adhesive can bond the first and second rigid fiber-reinforced shells to the structural element via chemical bonding, mechanical bonding, and combinations thereof. Typically, the first adhesive comprises a polymer, or a combination of components that are polymerized before, during, and/or after adhering the first and second rigid fiber-reinforced shells to the structural element. Accordingly, the first adhesive can be solvent based, such as a dispersion, emulsion, or solution.

Examples of suitable adhesives for use as the first adhesive include non-reactive adhesives, such as hot melt adhesives, drying adhesives, pressure-sensitive adhesives, contact adhesives, and the like, and reactive adhesives, such as single-component adhesives and multi-component adhesives. Specific examples of suitable adhesives include epoxies, polyurethanes, polyolefins, ethylene-vinyl acetates, polyamides, polyesters, styrene block copolymers, polycarbonates, fluoropolymers, silicone rubbers, and the like, and combinations thereof. Particular examples of suitable adhesives include CarbonBond™ adhesive putties, commercially available from DowAksa USA of Marietta, Ga., such as DowAksa CarbonBond™ 200P Adhesive Putty, DowAksa CarbonBond™ 200-UW Adhesive Putty, DowAksa CarbonBond™ 200-HT Adhesive Putty, and the like. In some embodiments, the first adhesive is a resin comprising an epoxy. In these or other embodiments, the first adhesive is a resin comprising an epoxy and an amine curing agent. In such embodiments, the first adhesive is typically applied as an uncured resin.

In certain embodiments, the method further comprises repeating (i)-(iii) described above, along the distance of the structural element between the first and second ends with additional rigid fiber-reinforced shells. In such certain embodiments, pairs of the additional rigid fiber-reinforced shells may be positioned along the distance of the structural element such that the first and/or second ends of one pair of the additional rigid fiber-reinforced shells is adjacent the first and/or second end of another pair of the additional rigid fiber-reinforced shells (e.g. in a stacked arrangement). Multiple different stacked arrangements may be utilized together.

In certain embodiments, the method additionally comprises (iv) positioning the third rigid fiber-reinforced shell about at least one of the first and second seams, to leave the other of the first and second seams as an exposed seam. In such certain embodiments, positioning the third rigid fiber-reinforced shell about at least one of the first and second seams comprises disposing at least a portion of the interior surface of the third rigid fiber-reinforced shell into close proximity with the first or second seam, a portion of the exterior surface of the first rigid fiber-reinforced shell, and a portion of the exterior surface of the second rigid fiber-reinforced shell. In some embodiments, the interior surface of the third rigid fiber-reinforced shell is shaped complementarily to the portion of the exterior surface of the first rigid fiber-reinforced shell and the portion of the exterior surface of the second rigid fiber-reinforced shell. In specific embodiments, the method comprises positioning the third rigid fiber-reinforced shell about the first seam. In other embodiments, the method comprises positioning the third rigid fiber-reinforced shell about the second seam. In some embodiments, at least a portion of the interior surface of the third rigid fiber-reinforced shell is disposed about and contiguous to the exterior surface of the first and second rigid fiber-reinforced shells. In certain embodiments, at least a portion of the interior surface of the third rigid fiber-reinforced shell is disposed about and spaced apart from the exterior surface of the first and second rigid fiber-reinforced shells.

In further embodiments, the method also comprises (v) positioning the fourth rigid fiber-reinforced shell about the exposed seam.

Positioning the fourth rigid fiber-reinforced shell about the exposed seam typically comprises disposing the first edge of the fourth rigid fiber-reinforced shell adjacent to the first edge of the third rigid fiber-reinforced shell to give a third seam and disposing the second edge of the fourth rigid fiber-reinforced shell adjacent to the second edge of the third rigid fiber-reinforced shell to give a fourth seam, thereby enveloping the first and second rigid fiber-reinforced shells with the third and fourth rigid fiber-reinforced shells. The first and/or second edges of the third and fourth rigid fiber-reinforced shells may be disposed contiguous to, overlapping with, or spaced apart from one another, or combinations thereof. In some embodiments, the first and/or second edges of the third and fourth rigid fiber-reinforced shells are disposed contiguous to one another. In other embodiments, the first and/or second edges of the third and fourth rigid fiber-reinforced shells are disposed adjacent to, but not touching, one another. In specific embodiments, the first and/or second edges of the first and second rigid fiber-reinforced shells are disposed overlapping one another.

In some embodiments, at least a portion of the interior surface of the fourth rigid fiber-reinforced shell is disposed about and contiguous to the exterior surface of the first and second rigid fiber-reinforced shells. In certain embodiments, at least a portion of the interior surface of the fourth rigid fiber-reinforced shell is disposed about and spaced apart from the exterior surface of the first and second rigid fiber-reinforced shells.

It is to be appreciated that the widths of the third and fourth rigid fiber-reinforced shells determine the orientation of the third and fourth seems, with respect to one another, about the axis A. For example, where the widths of the third and fourth rigid fiber-reinforced shells are substantially equal, the third and fourth seams are substantially opposite one another about the axis A. Typically, the third and fourth seams are arranged about the axis A in an orientation of from 170 to 190, alternatively from 175 to 185, alternatively of 180, degrees with respect to one another.

The third and fourth seams may be offset relative to the first and second seams about the axis A. In particular embodiments, the third and fourth seams are offset about 90 degrees, relative to the first and second seams, about the axis A, such that each of the first, second, third, and fourth seams is spaced about 90 degrees from one another about the axis A. In such embodiments, the term "about 90 degrees" is used to refer to an offset from one another about the axis A of from 80 to 110, alternatively from 85 to 95, alternatively of 90, degrees.

It is to be appreciated that the third and fourth rigid fiber-reinforced shells may be the same as or different from the first and second rigid fiber-reinforced shells. In some embodiments, the third and fourth rigid fiber-reinforced shells are the same as the first and second rigid fiber-reinforced shells but with a larger perimeter.

In further embodiments, the method also comprises (vi) adhering the third and fourth rigid fiber-reinforced shells about the first and second rigid fiber-reinforced shells.

Adhering the third and fourth rigid fiber-reinforced shells about the first and second rigid fiber-reinforced shells typically comprises applying a second adhesive between the interior surfaces of the third and fourth rigid fiber-reinforced shells and the exterior surfaces of the first and second rigid fiber-reinforced shells. The second adhesive can be applied by any means, such as via brushing, rolling, spraying, pumping, and the like. The second adhesive can be applied manually or by an automated process. In certain embodiments, the second adhesive is applied between the interior surfaces of the third and fourth rigid fiber-reinforced shells and the exterior surface of the first and second rigid fiber-reinforced shells by pumping or spraying, such as via an applicator or spray gun. It is also to be appreciated that the second adhesive may be applied to the interior surfaces of the third and fourth rigid fiber-reinforced shells and the exterior surface of the first and second rigid fiber-reinforced shells at any time, and in any order. For example, in some embodiments, the second adhesive may be applied to the interior surfaces of the third and fourth rigid fiber-reinforced shells prior to such shells being positioned about the first and second rigid fiber-reinforced shells. In these or other embodiments, the second adhesive may be applied to the interior surfaces of the third and fourth rigid fiber-reinforced shells subsequent to such shells being positioned about the first and second rigid fiber-reinforced shells. In some embodiments, the second adhesive may be applied to the exterior surface of the first and second rigid fiber-reinforced shells prior to the third and fourth rigid fiber-reinforced shells such shells being positioned about the first and second rigid fiber-reinforced shells.

The second adhesive can be any adhesive suitable for bonding the third and fourth rigid fiber-reinforced shells to the first and second rigid fiber-reinforced shells, such as a cement, glue, resin, and the like. Further, the second adhesive can bond the third and fourth rigid fiber-reinforced shells to the first and second rigid fiber-reinforced shells via chemical bonding, mechanical bonding, and combinations thereof. Typically, the second adhesive comprises a polymer, or a combination of components that are polymerized before, during, and/or after adhering the third and fourth rigid fiber-reinforced shells to the first and second rigid fiber-reinforced shells. Accordingly, the second adhesive can be solvent based, such as a dispersion, emulsion, or solution.

Examples of suitable adhesives for use as the second adhesive include non-reactive adhesives, such as hot melt adhesives, drying adhesives, pressure-sensitive adhesives, contact adhesives, and the like, and reactive adhesives, such as single-component adhesives and multi-component adhesives. Specific examples of suitable adhesives include epoxies, polyurethanes, polyolefins, ethylene-vinyl acetates, polyamides, polyesters, styrene block copolymers, polycarbonates, fluoropolymers, silicone rubbers, and the like, and combinations thereof. Particular examples of suitable adhesives for use as the second adhesive include DowAksa CarbonBond™ 200P Adhesive Putty, DowAksa CarbonBond™ 200-UW Adhesive Putty and DowAksa CarbonBond™ 200-HT Adhesive Putty. In some embodiments, the second adhesive is a resin comprising an epoxy. In these or other embodiments, the second adhesive is a resin comprising an epoxy and an amine curing agent. In such embodiments, the second adhesive is typically applied as an uncured resin. It is to be appreciated that the second adhesive may be the same or different from the first adhesive. As such, in some embodiments, the first and second adhesives are the same. In other embodiments, the first and second adhesives are different.

In certain embodiments, the method further comprises repeating (iv) through (vi) described above, along the length of the structural element between the first and second ends with additional pairs of the rigid fiber-reinforced shells.

It is to be appreciated that (iv) through (vi) can be repeated using the additional pairs of the rigid fiber-reinforced shells. For example, the method may additionally comprise (vii) positioning a fifth rigid fiber-reinforced shell about one of the third and fourth seams, (vii) positioning a sixth rigid fiber-reinforced shell about the other of the third and fourth seams, and (ix) adhering the fifth and sixth rigid fiber-reinforced shells to the third and fourth rigid fiber-reinforced shells, using any of the methods and materials described above.

It is also to be appreciated that the method can be repeated to reinforce any or all portions of the structural element. For example, in some embodiments, the method is used to reinforce the entire distance between the first and second ends of the structural element. In other embodiments, the method is used to reinforce only a portion of the distance between the first and second ends of the structural element. Furthermore, the method can be used to reinforce any number of different portions of the structural element. Accordingly, the rigid fiber-reinforced shells may envelop the entire structural element, may envelop only a portion, or may envelop multiple portions of the structural element. In some embodiments, the rigid fiber-reinforced shells envelop the first and/or second end of the structural element such that the first or second ends of the rigid fiber-reinforced shells are conterminal with the first and/or second end of the structural element. In certain embodiments, the rigid fiber-reinforced shells envelop the first and/or second end of the structural element such that the first or second ends of the rigid fiber-reinforced shells extend for a distance past the first and/or second end of the structural element along the axis A.

It is further to be appreciated that the rigid fiber-reinforced shells may be disposed about the structural element in any configuration. For example, the first and second ends of both the first or second rigid fiber-reinforced shells of any one pair of rigid fiber-reinforced shells may be aligned or misaligned, such as in a conterminal configuration, staggered configuration, or combinations thereof. In some embodiments, the first and second ends of both the first and second rigid fiber-reinforced shells of any one pair rigid fiber-reinforced shells are aligned in a conterminal configuration. In specific embodiments, the first and second ends of both the first and second rigid fiber-reinforced shells of any one pair rigid fiber-reinforced shells are misaligned, such that the rigid fiber-reinforced shells are oriented about the structural element in a staggered configuration. In some embodiments, any of the first and/or second ends of any of the rigid fiber-reinforced shells may be conterminal or staggered with respect to any other of the first and/or second ends of any of the rigid fiber-reinforced shells.

With reference to the specific embodiment of the Figures, wherein like numerals generally indicate like parts throughout the several views, FIG. 1 shows a first pair of rigid fiber-reinforced shells that comprises a first rigid fiber-reinforced shell 12 and a second rigid fiber-reinforced shell 14, which are positioned to form a first seam 16 and a second seam 18. FIG. 1 also shows a second pair of rigid fiber-reinforced shells 20 disposed about the first pair of rigid fiber-reinforced shells 10. The second pair of rigid fiber-reinforced shells 20 comprises a third rigid fiber-reinforced shell 22 and a fourth rigid fiber-reinforced shell 24, which are positioned to form a third seam 26 and a fourth seam (not shown).

Figure 2:
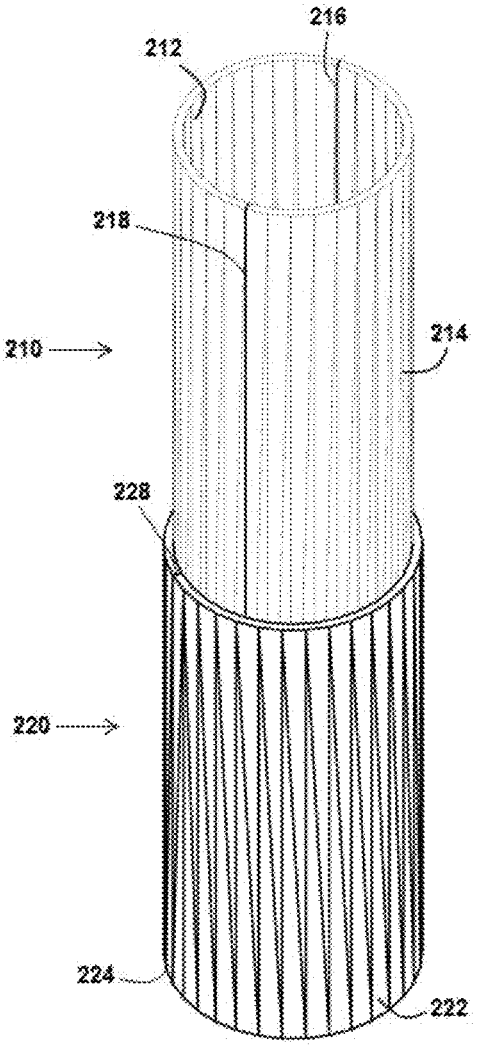
FIG. 2 shows a third pair of rigid fiber-reinforced shells and a fourth pair of rigid fiber-reinforced shells disposed about the third pair of rigid fiber-reinforced shells.

FIG. 2 shows a third pair of rigid fiber-reinforced shells 210 comprising a fifth rigid fiber-reinforced shell 212 and a sixth rigid fiber-reinforced shell 214, which are positioned to form a fifth seam 216 and a sixth seam 218. FIG. 2 also shows a fourth pair of rigid fiber-reinforced shells 220 disposed about the third pair of rigid fiber-reinforced shells. The fourth pair rigid fiber-reinforced shells 220 comprises a seventh rigid fiber-reinforced shell 222 and an eighth rigid fiber-reinforced shell 224, which are positioned to form a fifth seam (not shown) and a sixth seam 228.

Figure 3:
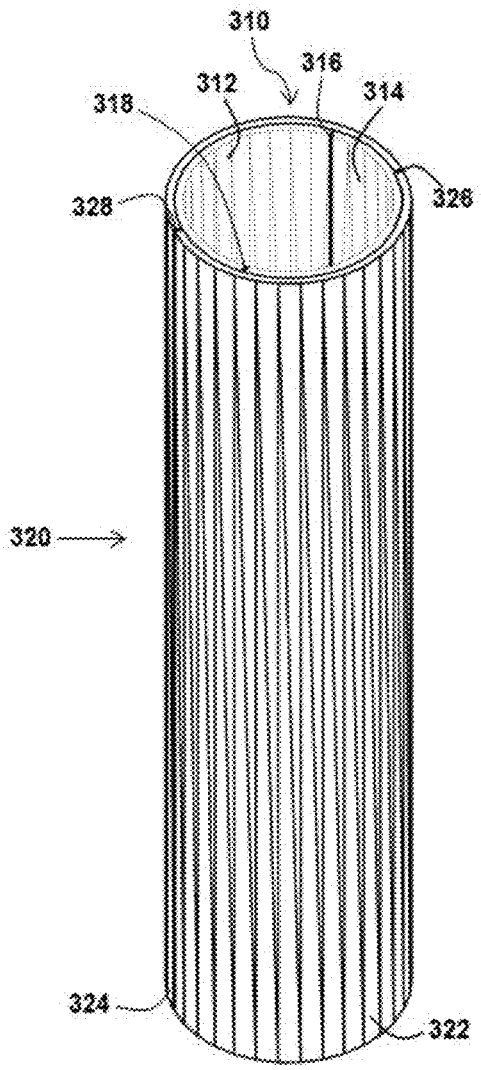
FIG. 3 shows a fifth pair of rigid fiber-reinforced shells and a sixth pair of rigid fiber-reinforced shells disposed about the fifth pair of rigid fiber-reinforced shells.

FIG. 3 shows a fifth pair of rigid fiber-reinforced shells 310 comprising a ninth rigid fiber-reinforced shell 312 and a tenth rigid fiber-reinforced shell 314, which are positioned to form a seventh seam 316 and an eighth seam 318. FIG. 3 also shows a sixth pair of rigid fiber-reinforced shells 320 disposed about the fifth pair of rigid fiber-reinforced shells 310. The sixth pair of rigid fiber-reinforced shells 320 comprises an eleventh rigid fiber-reinforced shell 322 and a twelfth rigid fiber-reinforced shell 324, which are positioned to form a ninth seam 326 and a tenth seam 328.

Figure 4:
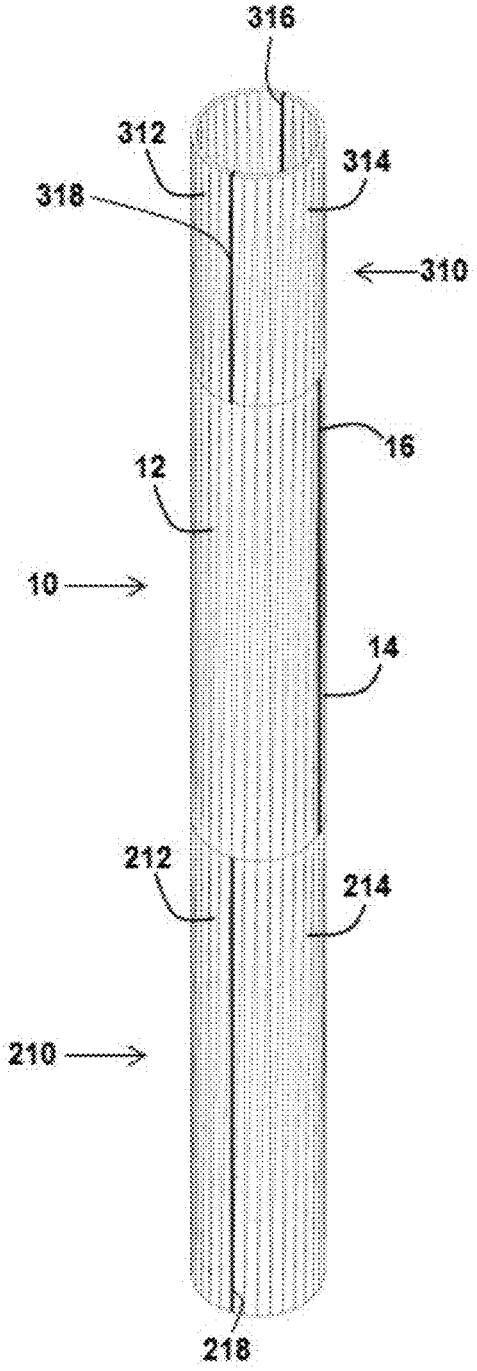
FIG. 4 shows the first, third, and fifth pairs of rigid fiber-reinforced shells positioned in a stacked arrangement.

FIG. 4 shows the first, third, and fifth pairs of rigid fiber-reinforced shells (10, 210, and 310, respectively) positioned in a stacked arrangement.

Figure 5:
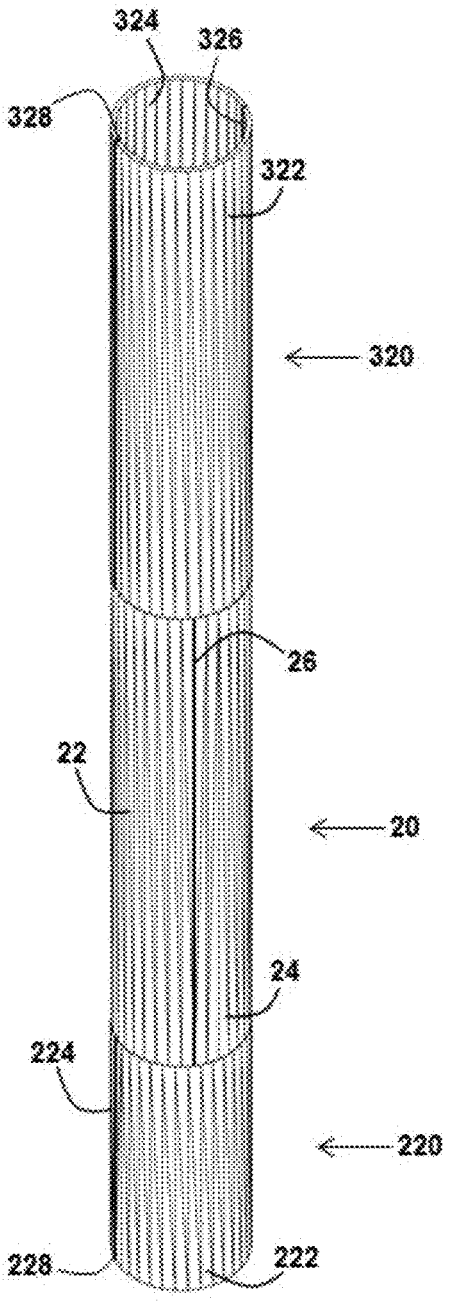
FIG. 5 shows the second, fourth, and sixth pairs of rigid fiber-reinforced shells positioned in a stacked arrangement.

FIG. 5 shows the second, fourth, and sixth pairs of rigid fiber-reinforced shells (20, 220, and 320, respectively) positioned in a stacked arrangement.

Figure 6:
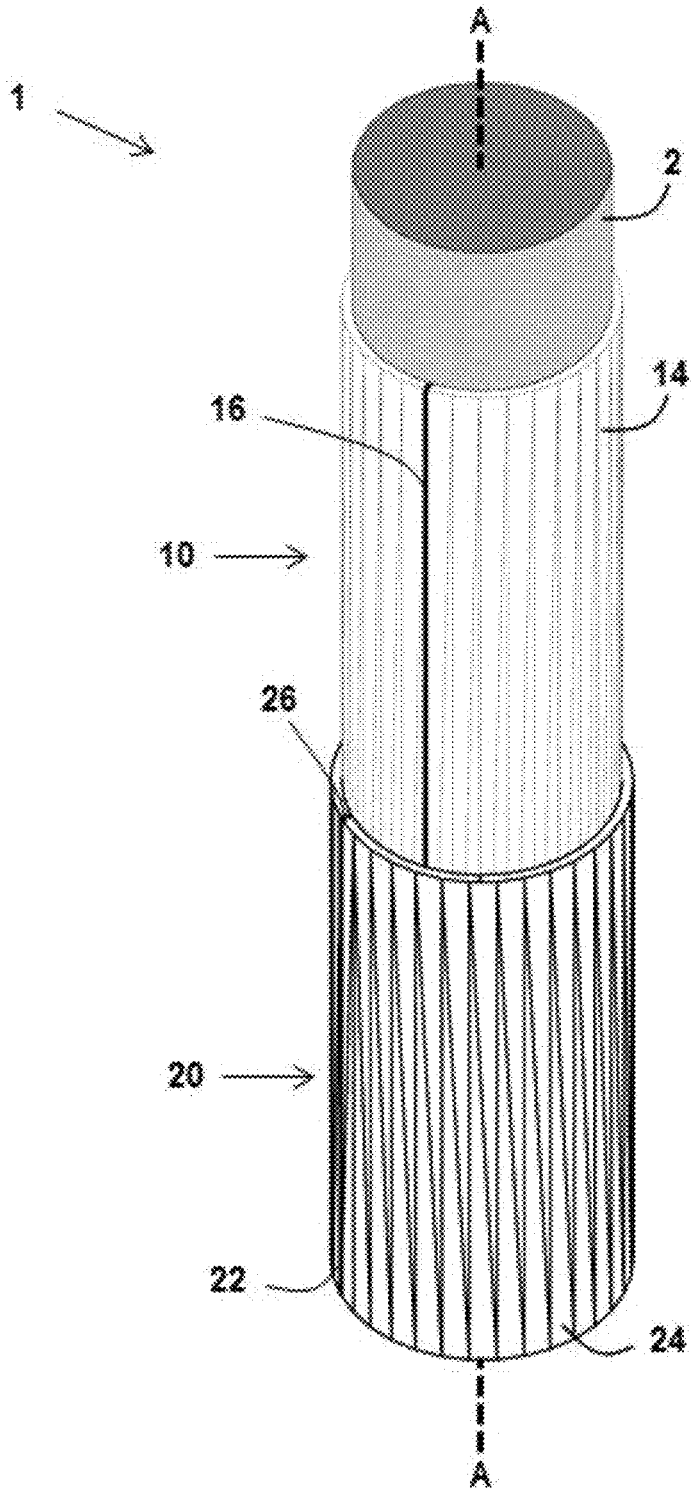
FIG. 6 shows a reinforced structural element formed in accordance with the method.

FIG. 6 shows a reinforced structural element 1 formed in accordance with the method exemplified with FIGS. 1-5. In particular, the reinforced structural element 1 comprises a structural element 2, the first pair of rigid fiber-reinforced shells 10, and the second pair of rigid fiber-reinforced shells 20. FIG. 6 also shows the first pair of rigid fiber-reinforced shells 10 disposed about the structural element 2, and the second pair of rigid fiber-reinforced shells 20 disposed about the first pair of rigid fiber-reinforced shells 10. The first pair of rigid fiber-reinforced shells 10 comprises the first rigid fiber-reinforced shell 12 and the second rigid fiber-reinforced shell 14, which are positioned to form the first seam 16 and the second seam 18 (not shown). The second pair of rigid fiber-reinforced shells 20 comprises the third rigid fiber-reinforced shell 22 and the fourth rigid fiber-reinforced shell 24, which are positioned to form the third seam 26 and the fourth seam (not shown).

The present invention further provides a reinforced structural element 1 formed by the method described above. Typically, the reinforced structural element 1 has different physical properties than the structural element 2, such as an improved (e.g. an increased) loading capacity, structural efficiency, stiffness, compression strength, and/or shear strength, compared to the structural element.

The invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The invention claimed is:

1. A method of reinforcing a structural element that extends along an axis, comprising the following steps:

(i) positioning a first rigid fiber-reinforced shell with first and second lateral edges about a first portion of an outer surface of the structural element;

(ii) positioning a second rigid fiber-reinforced shell with first and second lateral edges about a second portion of the outer surface of the structural element, such that the first lateral edge of the first rigid fiber-reinforced shell aligns with the first lateral edge of the second rigid fiber-reinforced shell to provide a first inner seam and the second lateral edge of the first rigid fiber-reinforced shell aligns with the second lateral edge of the second rigid fiber-reinforced shell to provide a second inner seam, thereby enveloping a perimeter of the structural element and becoming an inner shell pair comprising the first and second rigid fiber-reinforced shells and first and second ends;

(iii) adhering the inner shell pair to the structural element;

(iv) positioning a third rigid fiber-reinforced shell with first and second lateral edges about a first portion of an outer surface of the inner shell pair;

(v) positioning a fourth rigid fiber-reinforced shell with first and second lateral edges about a second portion of the outer surface of the inner shell pair, and such that the first lateral edge of the third rigid fiber-reinforced shell aligns with the first lateral edge of the fourth rigid fiber-reinforced shell to provide a first outer seam unaligned with the first and second inner seams and the second lateral edge of the third rigid fiber-reinforced shell aligns with the second lateral edge of the fourth rigid fiber-reinforced shell to provide a second outer seam unaligned with the first and second inner seams, thereby enveloping a perimeter of the inner shell pair and becoming an outer shell pair comprising the third and fourth rigid fiber-reinforced shells and first and second ends such that the second end of the outer shell pair is unaligned with the second end of the inner shell pair; and (vi) adhering the outer shell pair to the outer surface of the inner shell pair, becoming a dual reinforcement shell;

(vii) repeating steps (i) through (vi) one or more times to produce a stacked arrangement made up of a plurality of dual reinforcement shells comprising a plurality of inner shell pairs and a plurality of outer shell pairs, wherein for every inner shell pair, the first and second inner seams of an inner shell pair are unaligned with the first and second inner seams of every inner shell pair vertically adjacent to the inner shell pair, and wherein for every outer shell pair, the first and second outer seams of the outer shell pair are unaligned with the first and second outer seams of every outer shell pair vertically adjacent to the outer shell pair.

2. The method of claim 1, wherein for every inner shell pair, the first end of a first inner shell pair is conterminal with either the second end of a second inner shell pair, an external surface, or nothing.

3. The method of claim 1, wherein for every inner shell pair, the second end of a first inner shell pair is conterminal with either the first end of a second inner shell pair, an external surface, or nothing.

4. The method of claim 1, wherein for every outer shell pair, the first end of a first outer shell pair is conterminal with either the second end of a second outer shell pair, an external surface, or nothing.

5. The method of claim 1, wherein for every outer shell pair, the second end of a first outer shell pair is conterminal with either the first end of a second outer shell pair, an external surface, or nothing.

6. The method of claim 1, wherein for every inner shell pair the first and second inner seams are opposite one another, for every outer shell pair the first and second outer seams are opposite one another, and for every dual reinforcement shell the first and second outer seams are offset relative to the first and second inner seams about the axis.

7. The method of claim 1, wherein for every inner shell pair the first and second inner seams are offset by 170 to 190 degrees, for every outer shell pair the first and second outer seams are offset by 170 to 190 degrees, and for every dual reinforcement shell the first and second outer seams are offset relative to the first and second inner seams by 80 to 110 degrees.

8. The method of claim 1, wherein for every dual reinforcement shell the first and second inner seams of the dual reinforcement shell are offset relative to the first and second inner seams of a vertically adjacent dual reinforcement shell by 80 to 110 degrees, and the first and second outer seams of the dual reinforcement shell are offset relative to the first and second outer seams of the vertically adjacent dual reinforcement shell by 80 to 110 degrees.

9. The method of claim 1, wherein:

for every inner shell pair, the first and second rigid fiber-reinforced shells are complementary in shape and dimension and, as the inner shell pair, are complementary in shape and dimension to the structural element, such that the inner shell pair envelopes the structural element to provide a first reinforcement layer; and for every outer shell pair, the third and fourth rigid fiber-reinforced shells are complementary in shape and dimension and, as the outer shell pair, are complementary in shape and dimension to the inner shell pair, such that the outer shell pair envelopes the inner shell pair to provide a second reinforcement layer.

10. The method of claim 1, wherein for at least one of the dual reinforcement shells the first enclosing edge of the inner shell pair protrudes beyond the first end of the outer shell pair along the axis, such that the outer shell pair envelopes only a portion of a length of the inner shell pair along the axis.

11. The method of claim 1, wherein for at least one of the dual reinforcement shells the first enclosing edge of the outer shell pair protrudes beyond the first end of the inner shell pair along the axis, such that the inner shell pair adheres to only a portion of a length of the outer shell pair along the axis.

12. The method of claim 1, wherein for at least one of the dual reinforcement shells the second end of the inner shell pair is unaligned with the second end of the outer shell pair along the axis.

13. The method of claim 1, wherein:

step (iii) includes providing a first adhesive that contacts and extends between (a) the inner shell pair and (b) the structural element; and step (vi) includes providing a second adhesive that contacts and extends between (a) the outer shell pair and (b) the inner shell pair.

14. The method of claim 1, wherein:

step (iii) includes providing a first unhardened adhesive in a first gap between (a) the inner shell pair and (b) the structural element, and then converting the first unhardened adhesive into a first hardened adhesive that contacts and extends between (a) the inner shell pair and (b) the structural element; and step (vi) includes providing a second unhardened adhesive in a second gap between (a) the outer shell pair and (b) the inner shell pair, and then converting the second unhardened adhesive into a second hardened adhesive that contacts and extends between (a) the outer shell pair and (b) the inner shell pair.

* * * * *